United States Patent [19]

Roth et al.

[11] 4,191,016

[45] Mar. 4, 1980

[54] PUMPING JACK

[75] Inventors: Albert B. Roth, Lafayette; Albert Louie, San Leandro, both of Calif.

[73] Assignee: N L Industries, Inc., Hightstown, N.J.

[21] Appl. No.: 923,028

[22] Filed: Jul. 7, 1978

[51] Int. Cl.[2] ..... F15B 1/02

[52] U.S. Cl. ..... 60/371; 60/372; 91/218; 92/137

[58] Field of Search ..... 60/369, 371, 372, 413, 60/415; 74/589, 590; 91/218, 304; 92/137

[56] References Cited

U.S. PATENT DOCUMENTS

| | | | |
|---|---|---|---|
| 1,890,428 | 12/1932 | Ferris et al. | 60/372 |
| 2,780,063 | 2/1957 | Bacchi | 60/413 |
| 3,593,824 | 7/1971 | Gregory | 60/413 |

*Primary Examiner*—Edgar W. Geoghegan
*Attorney, Agent, or Firm*—Lothrop & West

[57] ABSTRACT

A pumping jack for use with a well having a vertically reciprocable polish rod has a base including a horizontally extending table. A hydraulic cylinder is mounted on the base, with the cylinder axis extending parallel to and above the table. A plunger is reciprocable in the cylinder along the axis and carries with it a block including a first sheave around which a first flexible line is reeved. One end of the first line is affixed to the base, and the other end of the first line extends around a well sheave mounted on the base with the well sheave periphery tangent to the polish rod, the line from the well sheave being affixed to the polish rod. The reciprocating parts are balanced at least in part in either of two ways. In one way, there is a pneumatic chamber variable in volume in accordance with the reciprocation of the polymer and provided with air under an elevated pressure sufficient to counterbalance or offset part of the reciprocating load. In the other way, the plunger carries a second sheave around which a second line is reeved, one end of the second line being secured to the base, and the other end of the second line being reeved around a weight sheave mounted on the base. A weight is secured to the end of the second line depending from the second sheave and has a mass to offset or counterbalance at least part of the reciprocating load. Thus, at least part of the weight of the polish rod and the pumping loads on it is counterbalanced either pneumatically or by gravity or both.

7 Claims, 4 Drawing Figures

PUMPING JACK

BRIEF SUMMARY OF THE INVENTION

Disposed near a well having a vertically reciprocable polish rod is a base. Fastened to the base is a hydraulic cylinder having a plunger therein designed to reciprocate along a horizontal axis. The plunger carries a block on which is mounted a first sheave. A first flexible line at one end is affixed to the base, extends or is reeved around the first sheave, then is reeved around a well sheave mounted on the base tangent to the polish rod, and at the other end is affixed to the polish rod. The mechanism is provided with a hydraulic transmission between an electric driving motor and the cylinder and plunger, so that the plunger is timed and driven to reciprocate within the cylinder and thus to reciprocate the polish rod to pump from the well.

DETAILED DESCRIPTION

Figures 1, 2:
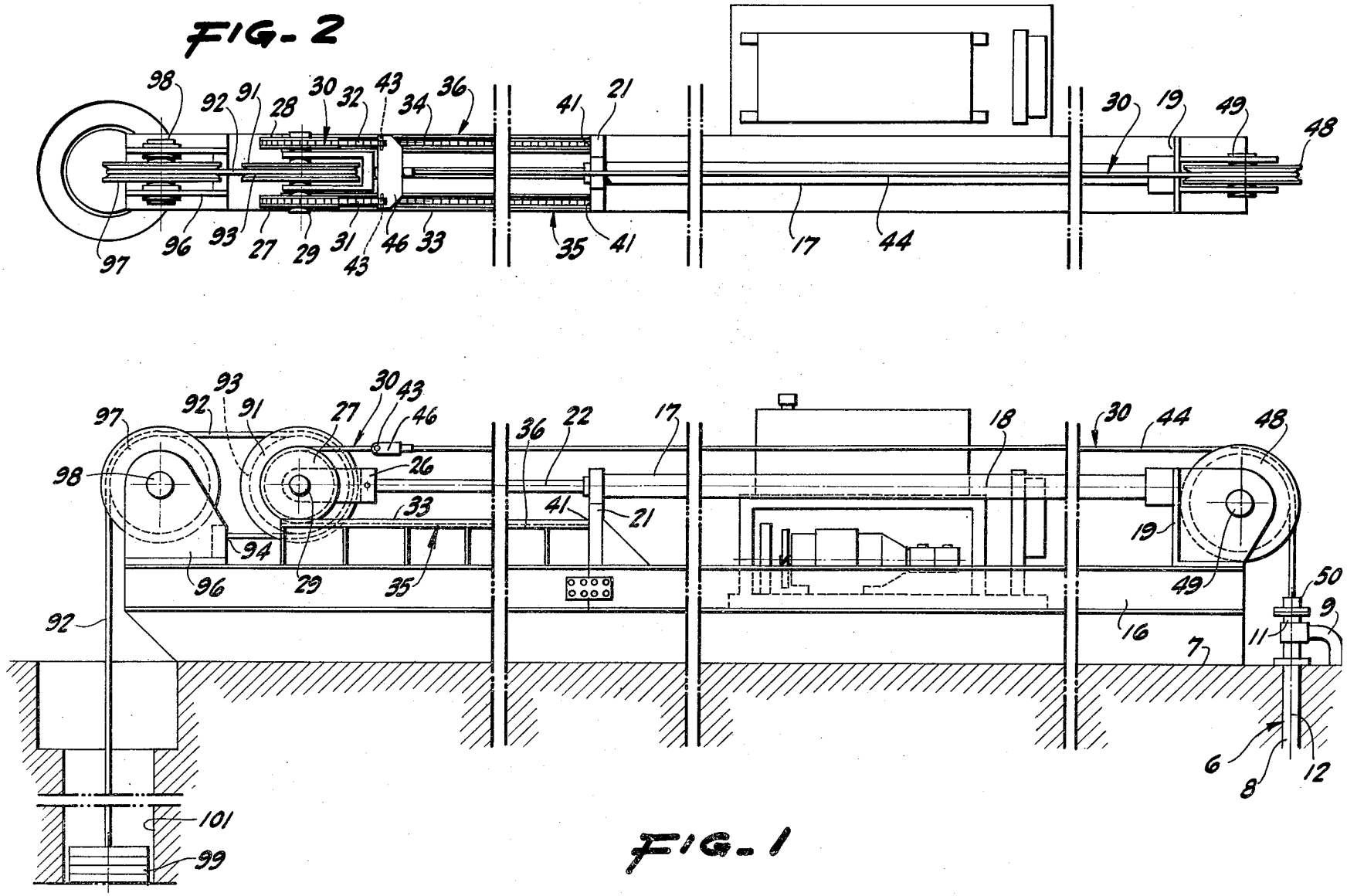
FIG. 1 is a side elevation of one from of pumping jack pursuant to the invention including a counterweight compensator.
FIG. 2 is a plan of the structure of FIG. 1.

In many fields the removal of liquids; for example, petroleum, has been such that originally flowing wells are required to be mechanically pumped, and in some fields well pumping has always been required. One of the problems is to provide a way of operating the polish rod of the mechanical pumps normally utilized in a simple, economical, long-lived and troublefree manner.

A large number of pumping jacks have been proposed from time to time for this purpose. Among other patented devices known to the applicants, but by no means an exclusive or exhaustive list of all such patents, are patents as follows:

| | |
|---|---|
| 2,325,138 Kyle et al. | 2,582,836 Kyle |
| 2,470,252 Kyle | 2,595,307 Selberg |
| 2,481,623 Rued | 2,617,256 White |
| 2,502,895 Shaffer | 2,654,221 Rued |
| 2,504,218 Noll et al. | 2,702,025 Bacchi |
| 2,562,837 White | 2,729,942 Billings et al. |
| 2,564,285 Smith | 2,755,780 Bacchi |
| 2,566,295 Alward | 2,780,063 Bacchi |
| 2,572,748 Noll et al. | 2,838,910 Bacchi |
| 2,575,241 White | 2,843,089 Bacchi et al. |
| 2,515,308 White | 3,782,117 James |

Despite the development of pumping jacks in general and as represented by the foregoing patents, there is still a requirement for an improved mechanism. Even the most recent patent listed, to James, when embodied as shown gives an installation that extends high in the air with substantial masses far above the ground and overhanging. There can easily be eccentric loading and transverse force inequality. There can be substantial bending stress in the piston rods and telescoping tubes especially when projected and relative short bearing areas with opportunity for extended leakage areas. Also, there is a large number of parts, some of which, such as packing glands, are difficult to access for service and repair. To meet current requirements and to improve over the art, there has been provided herein a fundamental structure compensated in either of two, or perhaps by a combination of two, different ways. A typical installation is in connection with an oil well 6 in the ground 7, the well including a casing 8 leading to a discharge line 9 and being operated by means of a polish rod 11 designed to reciprocate vertically or along an upright axis 12. The customary stroke of the polish rod varies from region to region and even from well to well, but in the present example the polish rod stroke is in the neighborhood of forty feet. The number of reciprocations per minute is variable, depending entirely upon the nature of the well and the speed at which it is to be pumped, but as an example can be given as ten strokes per minute.

Pursuant to the invention, there is provided on the ground 7 near the well a base 16. This conveniently is a fabricated assembly generally self-contained or made up of a few parts readily assembled and disassembled so that the base is portable and can be used in different areas at different times.

On the base 16 there is mounted a hydraulic cylinder 17 arranged with its axis 18 in a generally horizontal plane, the cylinder being supported by a bracket 19 upstanding from the base 16 at one end of the cylinder and by a bracket 21 upstanding from the base near the other end of the cylinder.

Reciprocable within the cylinder and along the axis 18 in a plunger 22. Whether the plunger 22 is single-acting or has a rod with a piston end so as to be double-acting depends on a particular installation. In any event the plunger is effective to be moved by attendant mechanism to and fro within the cylinder 17.

Since it is desired to keep the plunger stroke to a relatively restricted value, in the present instance the stroke is half that of the polish rod and is but twenty feet.

To take care of the difference in polish rod and plunger stroke, the plunger 22 at its free end is preferably provided with a block 26. This is a specially constructed member firmly attached to the end of the plunger rod 22 and preferably carrying a pair of first sheaves 27 and 28 on a common cross shaft 29 journalled in the block 26. The first sheaves are specially made to have a channel shape in axial cross-section in order to receive and guard a first line 30 including a pair of flexible leaf chains 31 and 32. These are preferably designed to nest well within the channel cross-section of the first sheaves and particularly to lie against a pair of parallel rails 33 and 34 constituting a table, generally designated 35, forming part of the base 16 and having a surface 36 underlying and substantially parallel to the axis 18 of the cylinder and of the plunger. The leaf chains 31 and 32 thus lie freely on the surface of the rails 33 and 34 or table 35, which may also serve as a partial support and guide for the first sheaves 27 and 28. The first flexible line 30 is at one end anchored by having the ends of the leaf chains 31 and 32 fastened at points such as 41 to the upright bracket 21 on the base, whereas the other ends of the leaf chains are secured by pins 43 to receptive end portions of a yoke 46.

The first flexible line 30 is extended from the yoke 46, which can be considered as included in or part of the line 30, by a flexible cable 44 secured to the center of the yoke 46. The cable 44 extends above the table 35 and above the cylinder 17 and is reeved around a well sheave 48 journalled on a pin 49 in the bracket 19 on the base 16 and disposed with the well sheave periphery tangent to the axis 12. The flexible first line or cable 30 thus turns from horizontal runs to a vertical run and is affixed by a fastener 50 to the upper end of the polish rod 11.

With this arrangement, as the plunger 22 reciprocates within the cylinder 17, the block 26 is similarly reciprocated and the pair of first sheaves 27 and 28 reciprocates next to or by rolling on the rails 33 and 34 or table 35 to and fro throughout a twenty-foot stroke. The chains 31 and 32 acting around the sheaves 27 and 28 afford a two-to-one multiplication of the reciprocation of the plunger 22 in the movement of the yoke 46. This two-to-one motion multiplication is transmitted through the flexible line 44 to operate the polish rod throughout its full stroke of forty feet. The arrangement not only assists in guiding the relatively long plunger 22, but also precludes any possible transverse rocking and oscillation of the shaft 29 due to momentarily unbalanced loads and assures that the leaf chains 31 and 32 are always laid out and taken in in the proper attitude and with the line 44 always in substantial alignment not only with the yoke 46 but also with the well sheave 48.

Figure 3:
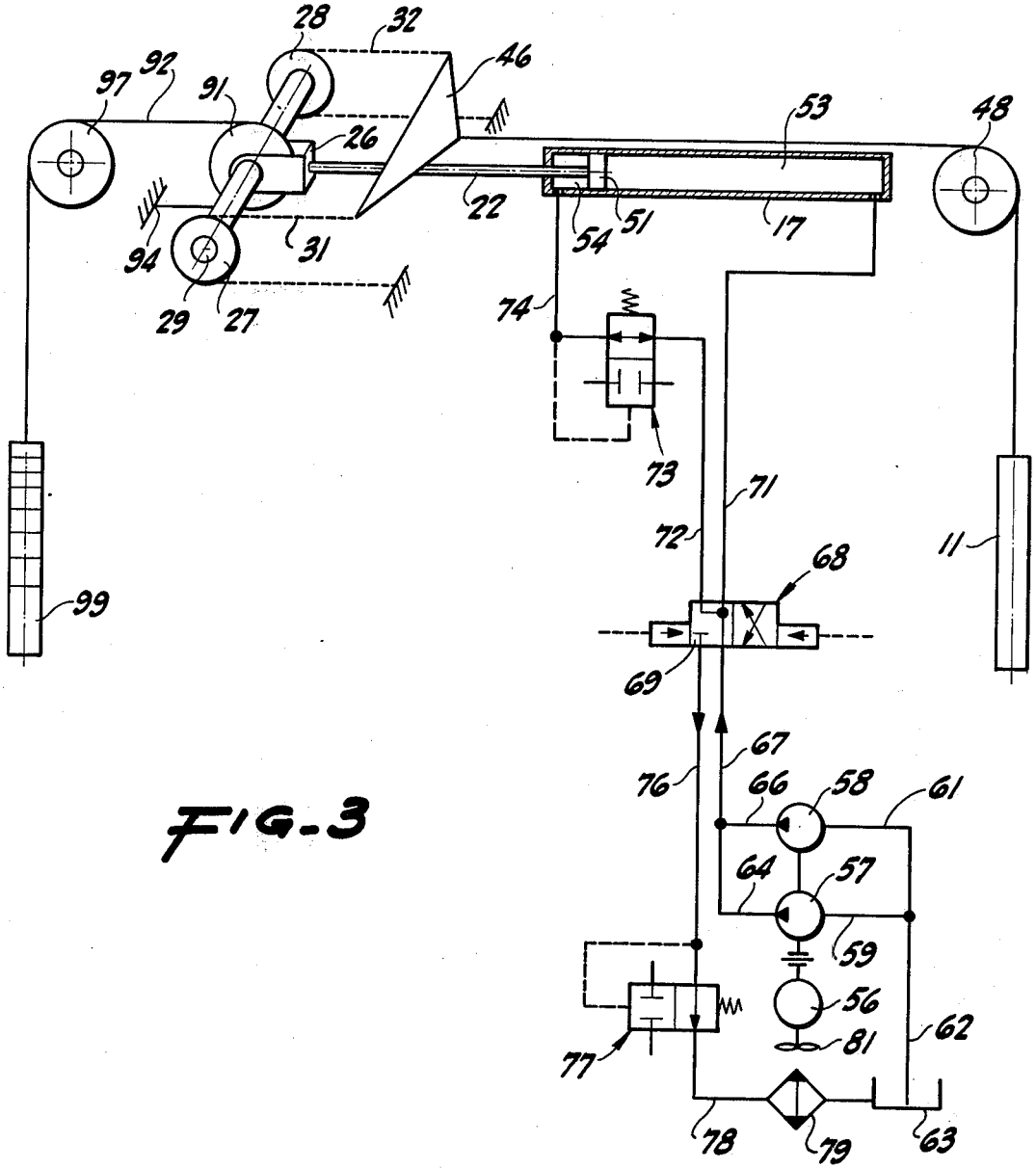
FIG. 3 is a diagram of the structure of FIGS. 1 and 2 inclusive of the hydraulic circuitry.

Various means may be utilized to afford reciprocation of the plunger 22 within the cylinder 17. In one instance, as particularly shown in FIG. 3, the cylinder 17 accommodates a piston 51 at the end of the double-acting plunger 22, the piston 51 dividing the cylinder into a pair of chambers 53 and 54. The chamber 54 has a lesser net cross-sectional area because of the rod 22. The chambers are variously supplied with hydraulic fluid in order to provide the desired reciprocation.

Power comes from an electric motor 56 coupled preferably to a pair of hydraulic pumps 57 and 58 arranged in parallel, having their inlet lines 59 and 61 joined to an inlet pipe 62 going to a hydraulic reservoir 63 provided with a supply of hydraulic liquid. The pumps 57 and 58 have outlets 64 and 66 joined to an outlet pipe 67 supplying fluid to a standard four-way valve 68. The valve spool 69 is shifted in any desired way; for example, mechanically or by solenoids, between a first position, as shown in the figure, and another position in which the valve core is translated to the left. As shown, the liquid from the supply pipe 67 goes through the four-way valve and leaves the valve in a pair of ducts 71 and 72. The duct 71 goes directly to the chamber 53 of the cylinder, whereas the duct 72 goes through a speed control valve 73 which can have its core shifted to allow a predetermined speed of operation. In the position shown, there is free flow from the duct 72 through the speed control valve 73 and through a line 74 into the chamber 54.

Since, because of the area of the rod 22, the area of the chamber 53 is larger than the area of the chamber 54, in the relationship of the parts shown, there is a hydraulic expulsion of the plunger 22 from the cylinder. This is accompanied by a translation of the block 26 and the attendant sheaves to the left in the figure, so that the polish rod is lifted. This action continues to the end of the stroke of the plunger in the cylinder or until the four-way valve 68 is reversed. When reversal occurs, as it does according to a timed program or automatically, then the cross connection in the spool 69 interconnects the pipe 67 with the duct 72 and interconnects the duct 71 with a return line 76 going through a speed control valve 77, like the speed control valve 73. The valve 77 is joined to a duct 78 passing through a heat exchanger 79 cooled by a fan 81 on the shaft of the motor 56. The operating liquid is so returned to the reservoir 63.

In this position of the four-way valve, the pressure hydraulic fluid in the pipe 67 is transferred to the duct 72 and through the speed control valve 73, thus tending to drive the piston 51 farther into the cylinder. This simultaneously discharges the hydraulic fluid in the chamber 53 through the line 71, thence into the return line 76 and through the speed control valve 77 back to the reservoir 63. As the motor 56 operates continuously and as the four-way valve 68 shuttles to and fro under appropriate control, the plunger rod 22 is reciprocated to and fro, with the speed of its outstroke and the speed of its instroke both being regulated. The mechanism as so far described is effective to operate the polish rod and to effectuate pumping.

One of the difficulties, however, is that the weight of the polish rod and the load on the polish rod may be very substantial, so that it is advisable to counteract part or all of them.

One of the two preferred ways of counteracting the polish rod weight is to provide on the block 26, and preferably journalled on the shaft 29, a central, second sheave 91 disposed between the pair of first sheaves 27 and 28 in order to have a laterally symmetrical, balanced arrangement, as shown in FIG. 2.

Trained or reeved around the second sheeve 91 is a second flexible line 92. This preferably is a cable lying in a groove 93 in the periphery of the second sheave 91. One end of the cable 92 is provided with an anchor 94 on a bracket 96 on the base 16. The second line 92 is extended to be reeved around a portion of the periphery of a weight sheave 97 journalled on a pin 98 in the bracket 96. The second line 92 depends vertically beyond the end of the base 16 and is fastened at its otherwise free end to a counterweight 99 preferably freely movable within a vertical pit 101 formed below the surface 7 of the ground. In this way the counterweight is readily housed and is generally out of the way at the surface, but is moved in consonance with the movement of the polish rod. That is because as the piston rod or plunger 22 reciprocates, the second flexible line 92 is paid in and out around the second sheave 91 and, in moving over the sheave 97, lifts and lowers the counterweight. With this mechanism, as much as desired of the otherwise uncompensated force on the polish rod is offset, so that the hydraulic force or power to produce the reciprocation is reduced substantially.

Under some circumstances, it is not desired to utilize a mechanical counterweight as just described, but rather to utilize a pneumatic compensator.

Figure 4:
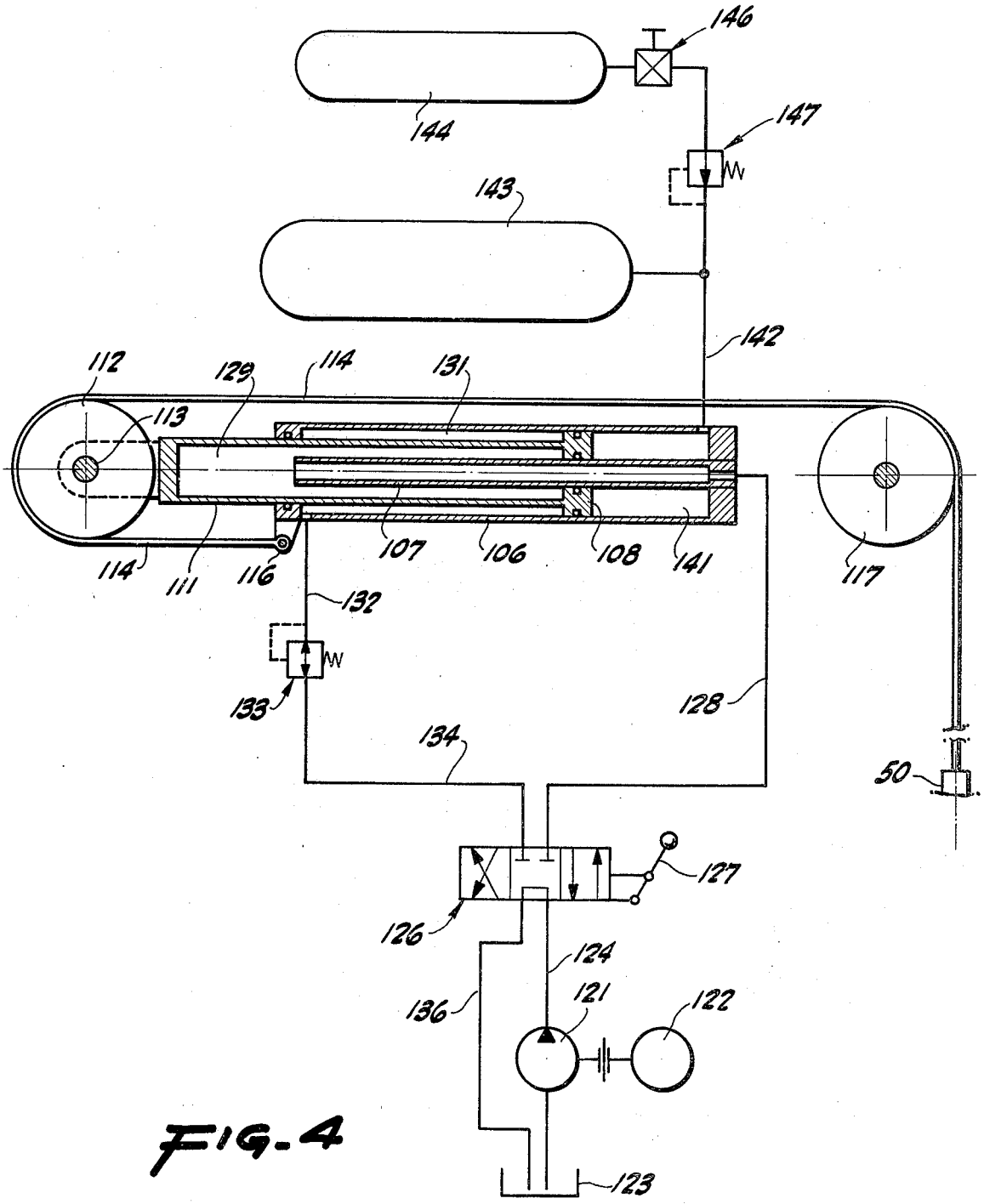
FIG. 4 is a diagram similar to FIG. 3 but showing hydraulic circuitry utilizing a pneumatic compensator in lieu of a counterweight compensator.

In that instance, as shown in FIG. 4, much of the mechanism is generally exactly the same as previously described, but there are changes in connection with the cylinder and piston arrangement. The cylinder 106 is provided with a special, axial hollow tube 107 projecting inwardly from the cylinder head. Reciprocable within the cylinder 106 and around the tube 107 is an annular piston 108 at the end of a hollow piston rod 111. The closed end or head of the piston rod 111 carries a sheave 112 or sprocket journalled on a pin 113. A flexible line 114 or a chain, if desired, at one end has a connection 116 to the cylinder and after being reeved around the sheave 112 extends to and is reeved over a sheave or sprocket 117 on the base 16. At its lower end the line 114 has a fitting 50 joined to the polish rod 11.

To reciprocate the annular piston 108 within the cylinder 106 there is provided a hydraulic pump 121 operated by an electric motor 122 and drawing from a reservoir 123. The pump discharge is through a line 124 into a four-way valve 126 having an appropriate control 127 thereon. Shown diagrammatically, the control represents either a mechanically timed or electrically timed operator to establish the valve position. There is a central position as shown in the figure in which liquid flow is blocked, one end position with the movable valve core to the left in which there is free flow in parallel fashion through the valve, and the other extreme or end position with the valve core to the right in which the flow crosses in the valve.

When the valve 126 is shifted with the core to the left in the figure, then flow from the pressure line 124 is straight through the valve core into a hydraulic line 128 going to the interior of the tube 107 and thence into a closed-end chamber 129 within the hollow piston rod 111. The tendency of the liquid under pressure then is to expel the piston rod 111 from the cylinder 106 and thus to tension the line 114 and to lift the polish rod. Under these conditions, the annular volume 131 between the hollow piston rod 111 and the cylinder 106 is in communication through a line 132 incorporating a speed control valve 133 and through a branch 134 and the leftwardly shifted four-way valve 126 into a line 136 back to the reservoir 123.

The piston rod 111 then goes to its extreme left-hand position unless the four-way valve 126 is earlier reversed. When such reversal occurs, the cross connection in the valve 126 is then interposed between the lines 124 and 134 and the lines 128 and 136. Then pressure from the line 124 is put through the line 134, through the speed control valve 133 and the line 132 into the chamber 131. This pressure tends to drive the piston 108 to the right in FIG. 4, expelling the liquid from the chamber 129 and through the interior of the tube 107 and through the lines 128 and 136 back to the reservoir 123. In this fashion there is alternate reciprocation afforded to the rod 111, so that the polish rod is moved up and down.

Operation of this sort can continue without compensation. When compensation is required or desired, then there is utilized a chamber 141 between the piston 108 and the right-hand head of the cylinder 106 and between the cylinder 106 and the tube 107. The chamber 141 is joined by a pneumatic line 142 to a pressure vessel 143 (which can be duplicated, if desired) usually maintained under an elevated gas pressure. The vessel 143 is supplied from a source 144 of gas such as nitrogen under high pressure. The source 144 is connected through a shut-off valve 146 and a pressure regulating valve 147 to the vessel or vessels 143. When the source vessel 144 is available and connected, there is a set maximum pressure established within the pressure vessel or vessels 143 and in the line 142 and the chamber 141.

As the piston 108 reciprocates under the hydraulic volume changes as described, as well as under the weight of the polish rod exerted thereon through the line 114, gas from the chamber 141 is expelled therefrom into the pressure vessel 143 and flows back from the pressure vessel into the chamber 141. In all instances the gas exerts a relatively constant although somewhat undulatory pressure against the annular face of the piston 108. The average value of this pressure and the range of this pressure are selected so that as much as desired of the polish rod load is compensated for.

Whether the mechanism is operated with no compensation or with pneumatic compensation of with weight compensation, it has been found that the operation of a pump polish rod with this arrangement is economically, effectively, reliably and satisfactorily done.

We claim:

1. A pumping jack for use with a vertically reciprocable polish rod comprising a base, a hydraulic cylinder having an axis, means for mounting said cylinder on said base with said axis horizontal, a plunger in said cylinder and having reciprocation along said axis, a block on said plunger, a first sheave on said block, a well sheave having a periphery, means for mounting said well sheave on said base with said well sheave periphery tangent to said polish rod, a first flexible line reeved around said first sheave and said well sheave, means for affixing one end of said first line to said polish rod, means for affixing the other end of said first line to said base, and hydraulic means for reciprocating said plunger in said cylinder.

2. A device as in claim 1 including a second sheave on said block, a weight sheave, means for mounting said weight sheave on said base, a second flexible line reeved around said second sheave and said weight sheave and having one end of said second line depending from said weight sheave, a weight affixed to said one end of said second line, and means for affixing the other end of said second line to said base.

3. A device as in claim 1 including a pneumatic reservoir variable in volume in accordance with said reciprocation of said plunger, means for charging said reservoir with a gas under elevated pressure, and means for hydraulically connecting said cylinder and said reservoir.

4. A device as in claim 1 including a horizontally extending table on said base in supporting relationship with said first flexible line.

5. A device as in claim 4 in which said table is established by two parallel rails on said base.

6. A device as in claim 5 in which said block includes a pair of said first sheaves disposed on opposite sides thereof, and one portion of said first flexible line includes chains disposed on said rails and each reeved around a respective one of said pair of said first sheaves.

7. A device as in claim 6 including a yoke connected to said chains and to a flexible cable.

* * * * *